US010357692B1

(12) United States Patent
Whitney et al.

(10) Patent No.: US 10,357,692 B1
(45) Date of Patent: Jul. 23, 2019

(54) LACROSSE HEAD WITH ASYMMETRICAL CROSS-STRUTS

(71) Applicant: East Coast Dyes, Inc., Towson, MD (US)

(72) Inventors: Hamilton Sean Michael Whitney, Baltimore, MD (US); Gregory Kenneally, Lutherville, MD (US); Brian Schaaf, West Chester, PA (US)

(73) Assignee: EAST COAST DYES, INC., Towson, MD (US)

( * ) Notice: Subject to any disclaimer, the term of this patent is extended or adjusted under 35 U.S.C. 154(b) by 0 days.

(21) Appl. No.: 16/138,072

(22) Filed: Sep. 21, 2018

(51) Int. Cl.
*A63B 59/20* (2015.01)
*A63B 49/02* (2015.01)
*A63B 102/14* (2015.01)

(52) U.S. Cl.
CPC ..... *A63B 49/02* (2013.01); *A63B 59/20* (2015.10); *A63B 2049/0211* (2013.01); *A63B 2102/14* (2015.10)

(58) Field of Classification Search
CPC ..... A63B 59/20
USPC ..... 473/513
See application file for complete search history.

(56) References Cited

U.S. PATENT DOCUMENTS 5,054,790 A 10/1991 Brine, III et al.
5,566,947 A 10/1996 Tucker et al.
5,674,140 A 10/1997 Tucker et al.
7,238,128 B1 * 7/2007 Filice ..... A63B 59/20 473/513
7,393,294 B2 7/2008 Filice et al.
7,695,382 B2 4/2010 Morrow et al.
7,993,221 B2 8/2011 Herman et al.
8,016,701 B2 9/2011 Lamson et al.
8,721,477 B2 5/2014 Chung
2004/0058758 A1 * 3/2004 Kohler ..... A63B 49/035 473/513
2008/0287227 A1 * 11/2008 Herman ..... A63B 59/20 473/513
2010/0113191 A1 * 5/2010 Winningham ..... A63B 59/20 473/513
2015/0011341 A1 * 1/2015 Janisse ..... A63B 60/00 473/513

(Continued)

OTHER PUBLICATIONS

"Alpha Ascension Lacrosse Head Product Video @SportStop.com," https://www.youtube.com/watch?v=CMHOw_4xtiU, published Jun. 6, 2018.

*Primary Examiner* — Mark S Graham
(74) *Attorney, Agent, or Firm* — Medler Ferro Woodhouse & Mills PLLC

(57) ABSTRACT

A frame of a lacrosse head includes a ball stop, a scoop, a left sidewall, and a right sidewall. Each of the left and right sidewalls includes a top rail, a bottom rail, a first cross-strut extending between the top and bottom rails thereof, and a second cross-strut extending between the top and bottom rails thereof. The second cross-struts are disposed closer to the ball stop than the first cross-struts. The second cross-strut of the left sidewall is longer than the first cross-strut of the left sidewall and extends from the top rail to the bottom rail in the direction of the scoop to the ball stop. The second cross-strut of the right sidewall is longer than the first cross-strut of the right sidewall and extends from the bottom rail to the top rail in the direction of the scoop to the ball stop.

25 Claims, 12 Drawing Sheets

(56) References Cited

U.S. PATENT DOCUMENTS

2016/0038802 A1* 2/2016 Morrow ..... D05B 1/02
473/513

* cited by examiner

LACROSSE HEAD WITH ASYMMETRICAL CROSS-STRUTS

FIELD OF THE INVENTION

The invention relates in general to lacrosse sticks, and more particularly to a frame of a lacrosse head of a lacrosse stick.

BACKGROUND OF THE INVENTION

In a game of lacrosse, face-offs occur at the beginning of each quarter of the game as well as after each goal. During a face-off, two opposing players face each other in the middle of the field, with the lacrosse ball placed on the ground on the center line between the heads of their sticks. Players facing off must rest their stick in their gloved hands on the ground and position themselves entirely behind the heads of their sticks. When the face-off commences, the players compete for possession of the lacrosse ball, often by trying to clamp the lacrosse ball under the backside of their lacrosse head and passing or directing the lacrosse ball to their teammates. To clamp the lacrosse ball, a player will rotate or turn his lacrosse stick to a position in which the backside of the lacrosse head covers the lacrosse ball with both of the opposing sidewalls of the lacrosse head adjacent or in close proximity to the ground. Winning possession of the ball during a face-off provides opportunities to score and ultimately win the game, and thus it is advantageous to provide a lacrosse stick configured to perform effectively during face-offs.

BRIEF SUMMARY OF THE INVENTION

Embodiments hereof are directed to a lacrosse head having a frame that includes a ball stop, a scoop opposing the ball stop, a left sidewall, and a right sidewall opposing the left sidewall. The left sidewall and the right sidewall are integrally formed with and extend between the ball stop and the scoop. Each of the left sidewall and the right sidewall includes a top rail and a bottom rail spaced apart from the top rail. Each of the left sidewall and the right sidewall includes a first cross-strut integrally formed with and extending between the top rail and the bottom rail thereof and a second cross-strut integrally formed with and extending between the top rail and the bottom rail thereof. The second cross-struts are disposed closer to the ball stop than the first cross-struts. The second cross-strut of the left sidewall is longer than the first cross-strut of the left sidewall and extends from the top rail to the bottom rail in the direction from the scoop to the ball stop. The second cross-strut of the right sidewall is longer than the first cross-strut of the right sidewall and extends from the bottom rail to the top rail in the direction from the scoop to the ball stop.

Embodiments hereof are also directed to a lacrosse head having a frame that includes a ball stop, a scoop opposing the ball stop, a left sidewall, and a right sidewall opposing the left sidewall. The left sidewall and the right sidewall are integrally formed with and extend between the ball stop and the scoop. Each of the left sidewall and the right sidewall includes a top rail and a bottom rail spaced apart from the top rail. Each of the left sidewall and the right sidewall includes a first cross-strut integrally formed with and extending between the top rail and the bottom rail thereof and a second cross-strut integrally formed with and extending between the top rail and the bottom rail thereof. The second cross-struts are disposed closer to the ball stop than the first cross-struts.

A first pattern of the first cross-strut and the second cross-strut of the left sidewall is asymmetric relative to a second pattern of the first cross-strut and the second cross-strut of the right sidewall with the right sidewall having a first flex point and the left sidewall having a second flex point, the first flex point being disposed closer to the ball stop than the second flex point, such that the frame is configured to twist during a face-off in order to trap a lacrosse ball between the left sidewall and the right sidewall and push the lacrosse ball towards the ball stop of the frame.

Embodiments hereof are also directed to a lacrosse head having a frame that includes a ball stop, a scoop opposing the ball stop, a left sidewall, and a right sidewall opposing the left sidewall. The left sidewall and the right sidewall are integrally formed with and extend between the ball stop and the scoop. Each of the left sidewall and the right sidewall includes a top rail and a bottom rail spaced apart from the top rail. Each of the left sidewall and the right sidewall includes a cross-strut integrally formed with and extending between the top rail and the bottom rail thereof. The cross-strut of the left sidewall extends from the top rail to the bottom rail in a direction from the scoop to the ball stop and the cross-strut of the right sidewall extends from the bottom rail to the top rail in the direction from the scoop to the ball stop. The cross-strut of the left sidewall is directly opposed to the cross-strut of the right sidewall, and no other cross-struts cross over each of the cross-struts of the left sidewall and the right sidewall.

BRIEF DESCRIPTION OF DRAWINGS

The foregoing and other features and advantages of the invention will be apparent from the following description of embodiments hereof as illustrated in the accompanying drawings. The accompanying drawings, which are incorporated herein and form a part of the specification, further serve to explain the principles of the invention and to enable a person skilled in the pertinent art to make and use the invention. The drawings are not to scale.

DETAILED DESCRIPTION OF THE INVENTION

Specific embodiments of the present invention are now described with reference to the figures, wherein like reference numbers indicate identical or functionally similar elements. The following detailed description is merely exemplary in nature and is not intended to limit the invention or the application and uses of the invention. Furthermore, there is no intention to be bound by any expressed or implied theory presented in the preceding technical field, background, brief summary or the following detailed description.

Figure 1:
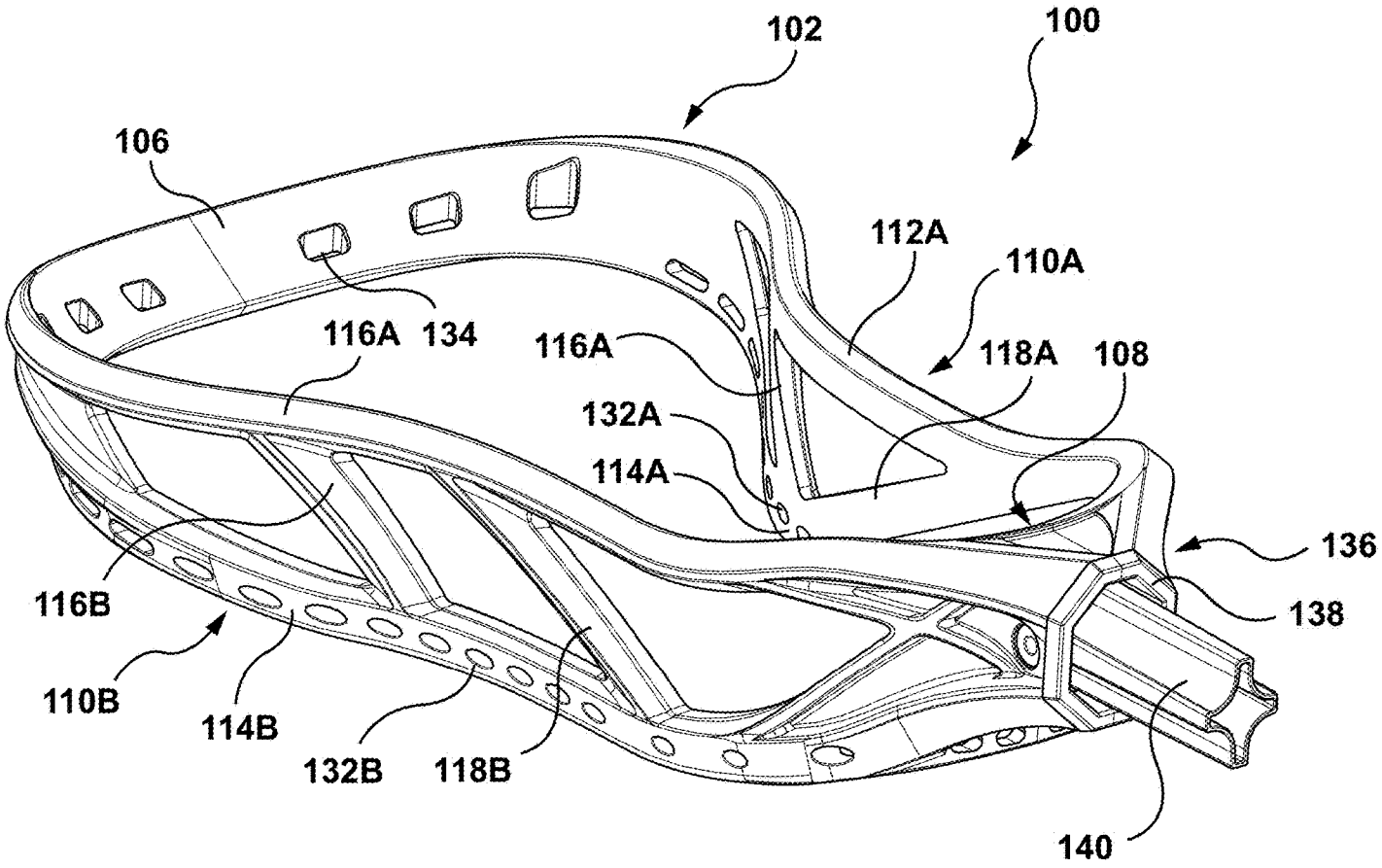
FIG. 1 is a perspective view of a lacrosse head having a frame according to an embodiment hereof.
Figure 2:
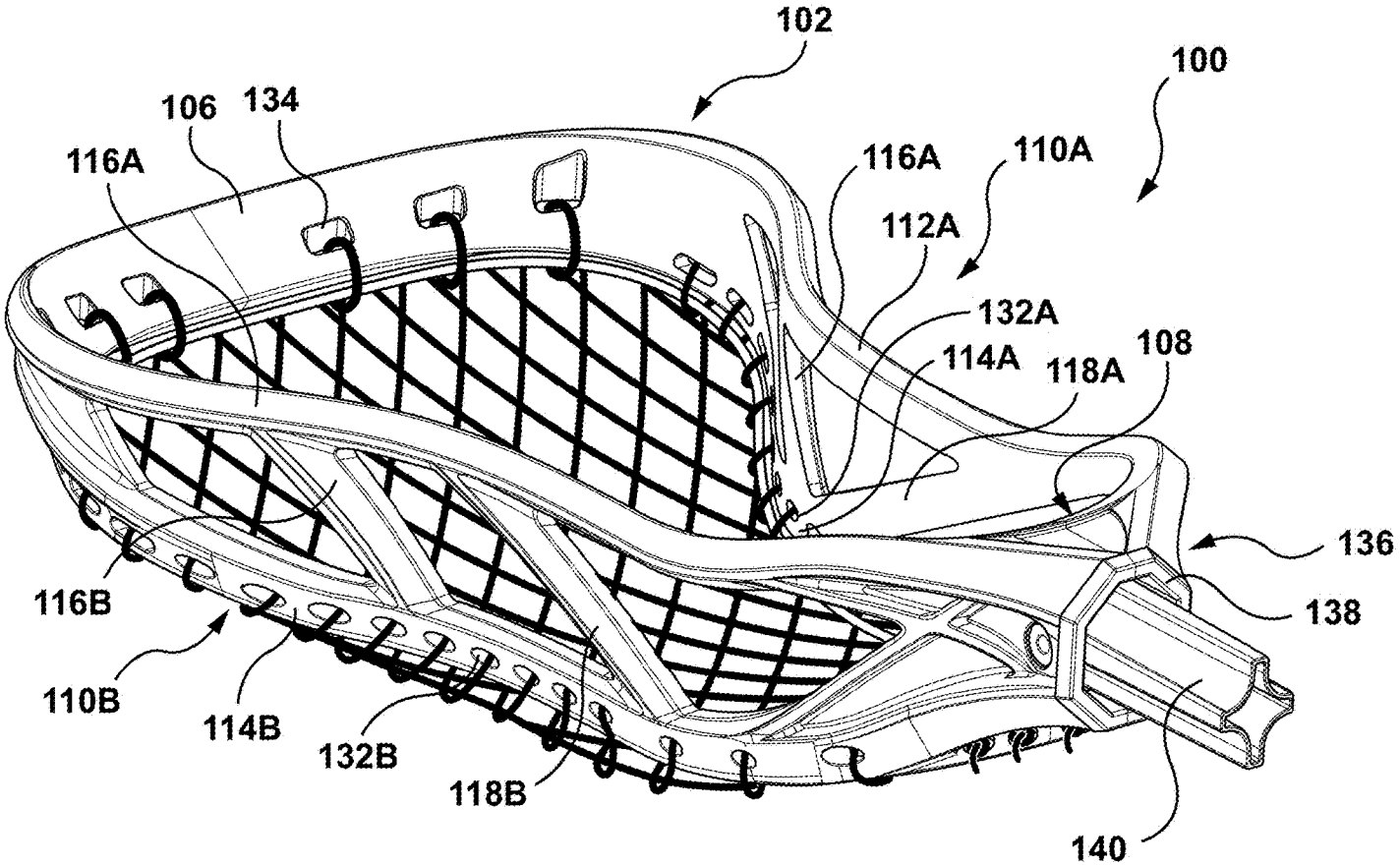
FIG. 2 is a perspective view of the lacrosse head of FIG. 1, wherein a netting is attached to the frame.

Embodiments hereof relate to a lacrosse head including a frame having a scoop, a ball stop, and a pair of opposing sidewalls. As will be explained in more detail herein, the pattern of cross-struts of the opposing sidewalls of the frame is asymmetrical such that the frame is configured to twist or flex during a face-off in order to trap or pinch a lacrosse ball between the opposing sidewalls of the frame. More particularly, with reference to FIGS. 1-2, a lacrosse head 100 includes a frame 102 supporting a netting 104 attached thereto. FIG. 1 illustrates a perspective view of the frame 102 without the netting 104 attached thereto, while FIG. 2 illustrates a perspective view of the frame 102 with the netting 104 attached thereto. The netting 104 of the lacrosse head 100 is configured to receive a lacrosse ball therein and the configuration thereof is merely exemplary. It is understood that any number of alternate netting configurations can be used with the frame 102 described herein.

The frame 102 includes a ball stop 108, a scoop 106 opposing the ball stop 108, a left sidewall 110B, a right sidewall 110A opposing the left sidewall 110B, and a throat 136 that defines a socket 138. The opposing right and left sidewalls 110A, 110B are integrally formed with and extend between the ball stop 108 and the scoop 106. Stated another way, each sidewall may be considered to include a top end and a bottom end, with the scoop 106 extending between and connecting the top ends of the opposing right and left sidewalls 110A, 110B and the ball stop 108 extending between and connecting the bottom ends of the opposing right and left sidewalls 110A, 110B. Although separately described, the above-described portions or sections of the frame 102 are integrally formed such that the frame 102 is a unitary structure formed from a single piece of material. The portions or sections of the frame 102 are separately described such that the shape, structure, function and advantages thereof are clear. In an embodiment, the frame 102 is a one-piece injection molded component. The frame 102 may be formed from conventional plastic injection molding techniques, gas-assist injection molding techniques, structural foam molding techniques, or other suitable molding techniques known in the art. The frame 102 may be any suitable thermoplastic polymer, including but not limited to nylon or polyamide. Although formed from a single unitary material, different molding textures may be utilized on particular portions or sections of the frame 102.

The throat 136 extends from the ball stop 108 in a direction away from the scoop 106 for attachment to a stick handle (not shown). In some embodiments, the socket 138 defined by the throat 136 includes an insert 140 which is configured to couple to a stick handle of a lacrosse stick. It will be understood that the throat 136 and/or socket 138 defined by the throat 136 can take on a variety of different configurations so long as the frame 102 is configured to be attached or coupled to a stick handle to form a lacrosse stick. For example, and not by way of limitation, in some embodiments, the insert 140 may be excluded such that the stick handle attaches directly to the throat 136.

The frame 102 includes a plurality of stringing holes to permit the netting 104 to be attached thereto. For example, the scoop 106 includes a plurality of stringing holes 134 formed therethrough, the right sidewall 110A includes a plurality of stringing holes 132A, and the left sidewall 110B includes a plurality of stringing holes 132B to allow the netting 104 to be attached to the frame 102. However, it will be understood that alternative methods and components may be utilized for attaching the netting 104 to the frame 102. Further, additional stringing holes may also be formed in other locations on the frame 102 to provide varying locations for attachment of the netting 104 that result in different configurations and depths of the netting 104.

Figure 3:
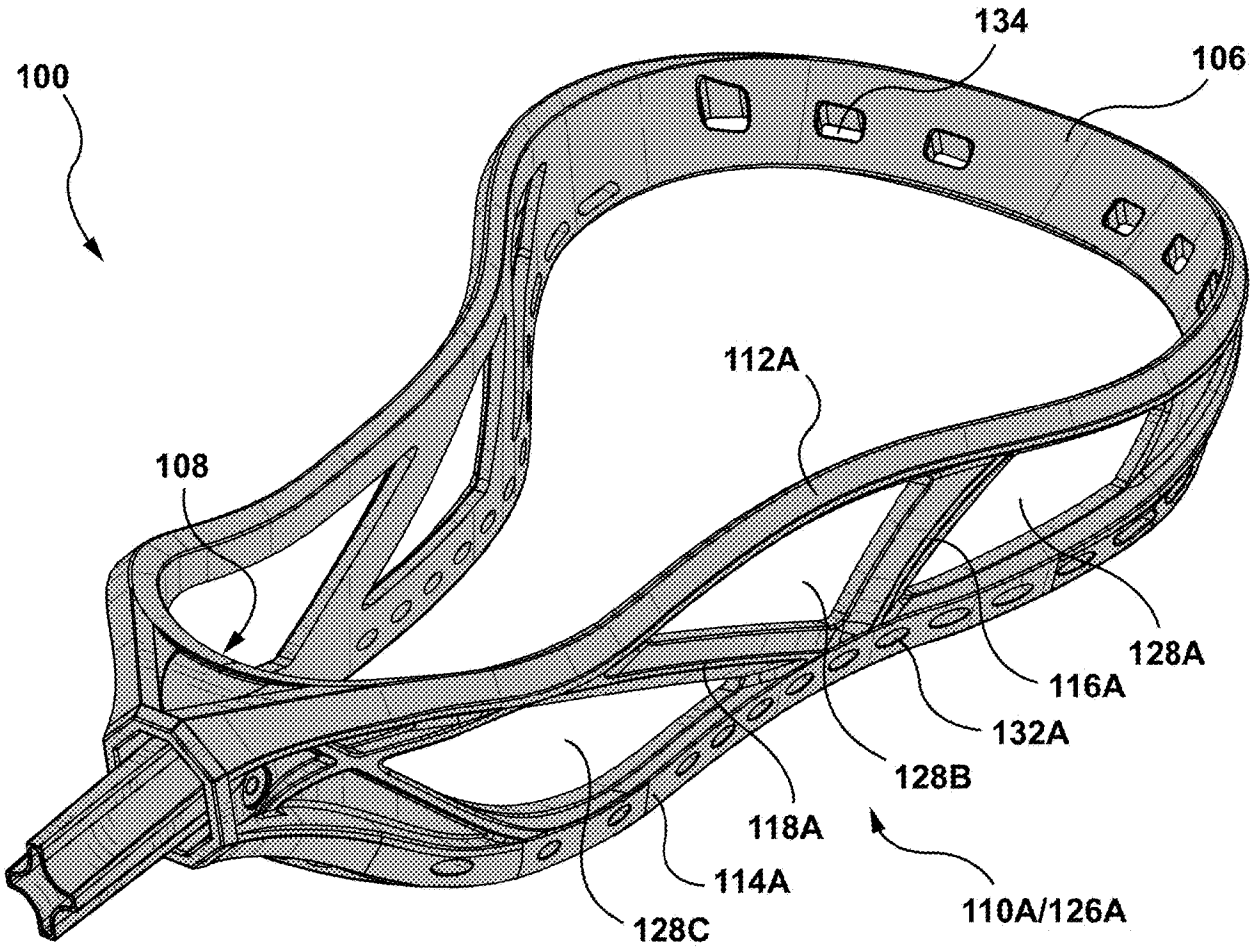
FIG. 3 is another perspective view of the lacrosse head of FIG. 1.
Figure 8:
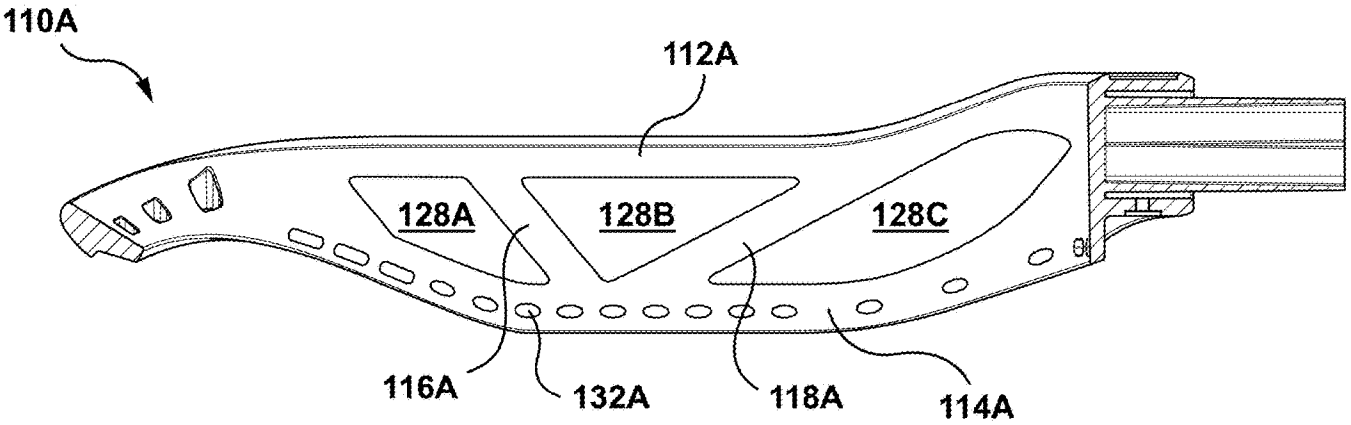
FIG. 8 is a side sectional view taken along line 8-8 of FIG. 7.

With further reference to the perspective view of FIG. 3 and the side sectional view of FIG. 8, the right sidewall 110A includes a top rail 112A and a bottom rail 114A spaced apart from the top rail 112A. The right sidewall 110A further includes a first cross-strut 116A integrally formed with and extending between the top rail 112A and the bottom rail 114A, and a second cross-strut 118A integrally formed with and extending between the top rail 112A and the bottom rail 114A. The second cross-strut 118A is disposed closer to the ball stop 108 than the first cross-strut 116A. The second cross-strut 118A of the right sidewall 110A is longer than the first cross-strut 116A of the right sidewall 110A. For example, in an embodiment, the first cross-strut 116A of the right sidewall 110A may have a length between 1.25-1.5 inches and the second cross-strut 118A of the right sidewall 110A may have a length between 2.3-2.6 inches. The first cross-strut 116A and the second cross-strut 118A of the right sidewall 110A do not intersect with or cross over each other, but rather collectively form a "V" or "U" shape and extend in opposite directions. Further, no other cross-struts intersect with or cross over at least the second cross-strut 118A. More particularly, the second cross-strut 118A extends from the bottom rail 114A to the top rail 112A in the direction of arrow A (i.e., from the scoop 106 to the ball stop 108), and conversely, the first cross-strut 116A extends from the top rail 112A to the bottom rail 114A in the direction of arrow A (i.e., from the scoop 106 to the ball stop 108). A first pattern 126A is defined by the first and second cross-struts 116A, 118A. The first pattern 126A of the right sidewall 110A may be considered an open sidewall construction, with three openings 128A, 128B, 128C defined by the first and second cross-struts 116A, 118A as best shown on the perspective view of FIG. 3 and the side sectional view of FIG. 8. In an embodiment, the second cross-strut 118A of the right sidewall 110A may form an angle between 25° and 30° with the top rail 112A while the first cross-strut 116A of the right sidewall 110A may form an angle between 45° and 55° with the top tail 112A. In another embodiment, the second cross-strut 118A of the right sidewall 110A forms an angle of 27.5° with the top rail 112A while the first cross-strut 116A of the right sidewall 110A forms an angle of 50° with the top tail 112A.

Figure 4:
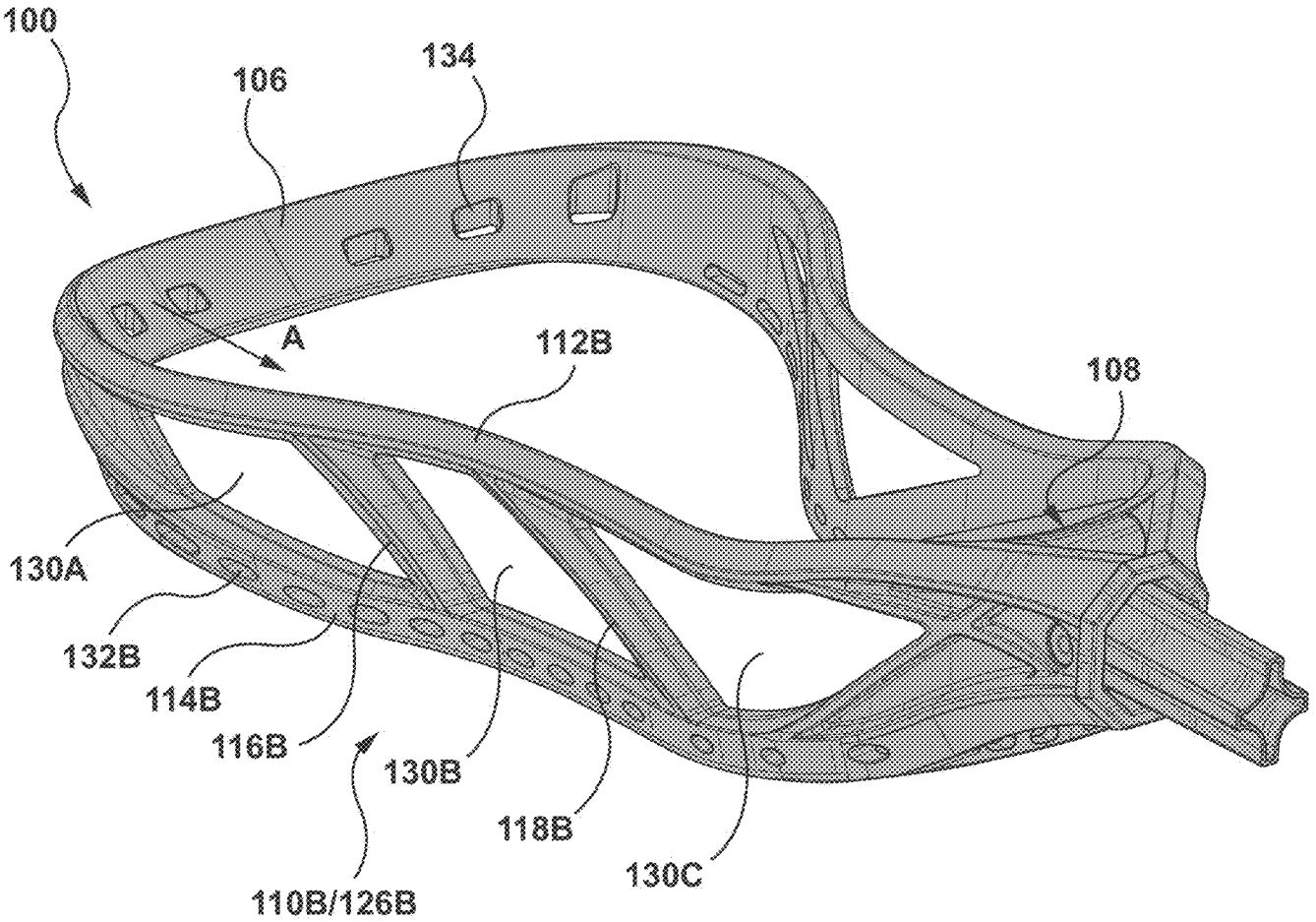
FIG. 4 is another perspective view of the lacrosse head of FIG. 1.
Figure 9:
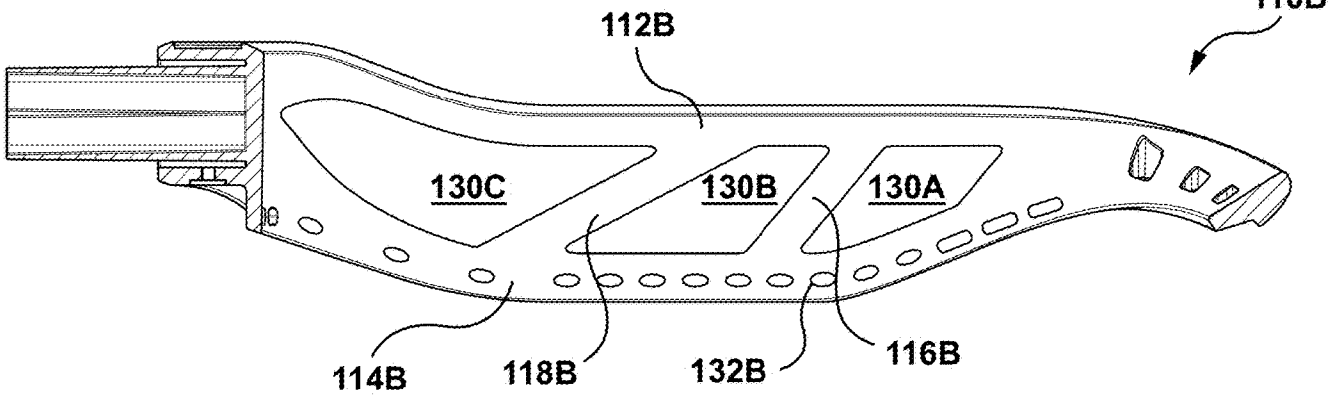
FIG. 9 is a side sectional view taken along line 9-9 of FIG. 7.

With further reference to the perspective view of FIG. 4 and the side sectional view of FIG. 9, the left sidewall 110B similarly includes a top rail 112B and a bottom rail 114B spaced apart from the top rail 112B. The left sidewall 110B includes a first cross-strut 116B integrally formed with and extending between the top rail 112B and the bottom rail 114B, and a second cross-strut 118B integrally formed with and extending between the top rail 112B and the bottom rail 114B. The second cross-strut 118B is disposed closer to the ball stop 108 than the first cross-strut 116B. The second cross-strut 118B of the left sidewall 110B is longer than the first cross-strut 116B of the left sidewall 110B. For example, in an embodiment, the first cross-strut 116B of the left sidewall 110B may have a length between 1.25-1.5 inches and the second cross-strut 118B of the left sidewall 110B may have a length between 2-2.5 inches. The first cross-strut 116B and the second cross-strut 118B of the left sidewall 110B do not intersect with each other, and extend in the same direction. Further, no other cross-struts intersect with or cross over at least the second cross-strut 118B. More particularly, the second cross-strut 118B extends from the top rail 112B to the bottom rail 114B in the direction of arrow A (i.e., from the scoop 106 to the ball stop 108), and the first cross-strut 116B of the left sidewall 110B also extends from the top rail 112B to the bottom rail 114B in the direction of arrow A (i.e., from the scoop 106 to the ball stop 108. A second pattern 126B is defined by the first and second cross-struts 116B, 118B. The second pattern 126B of the left sidewall 110B may be considered an open sidewall construction, with three openings 130A, 130B, 130C defined by the first and second cross-struts 116B, 118B as best shown on the perspective view of FIG. 4 and the side sectional view of FIG. 9. In an embodiment, the second cross-strut 118B of the left sidewall 110B may form an angle between 25° and 30° with the top rail 112B while the first cross-strut 116B of the left sidewall 110B may form an angle between 45° and 55° with the top tail 112B. In another embodiment, the second cross-strut 118B of the left sidewall 110B may form an angle of 27.5° with the top rail 112B while the first cross-strut 116B of the left sidewall 110B forms an angle of 50° with the top tail 112B.

The open sidewall construction of right and left sidewalls 110A, 110B substantially decreases the amount of material utilized for the frame 102, thereby decreasing the overall weight of the lacrosse head 102. In addition, the first pattern 126A of the right sidewall 110A and the second pattern 126B of the left sidewall 110B are asymmetric such that the frame 102 is configured to twist or flex during a face-off in order to trap or pinch a lacrosse ball within the right and left sidewalls 110A, 110B of the frame 102. The asymmetrical patterns are best shown and described via comparison between the right and left side views of FIGS. 5 and 6, respectively, as described in more detail below.

Figure 5:
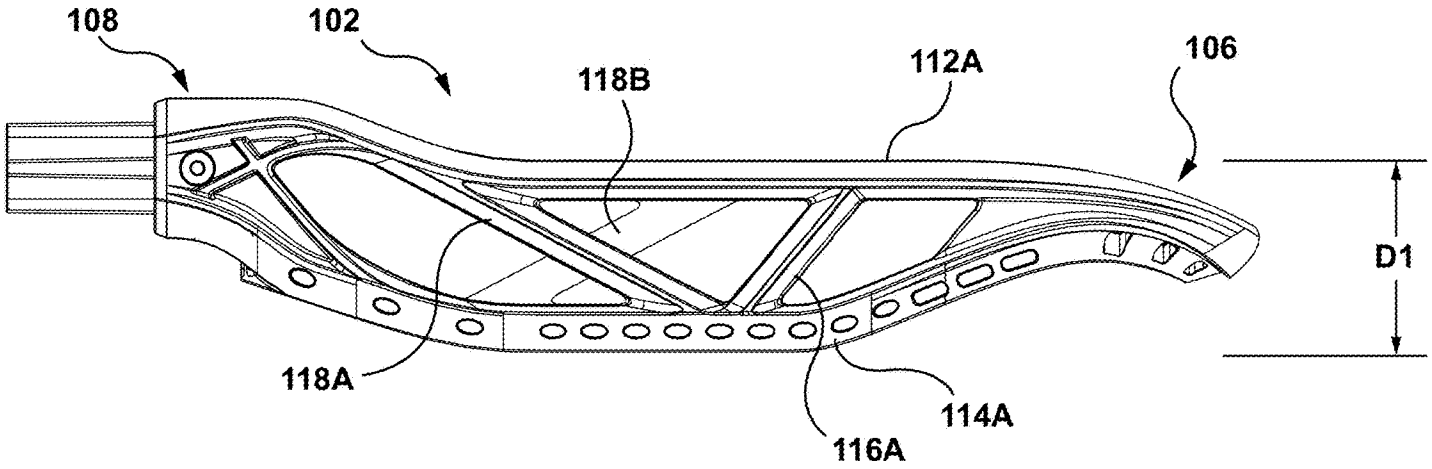
FIG. 5 is a right side view of the lacrosse head of FIG. 1.
Figure 6:
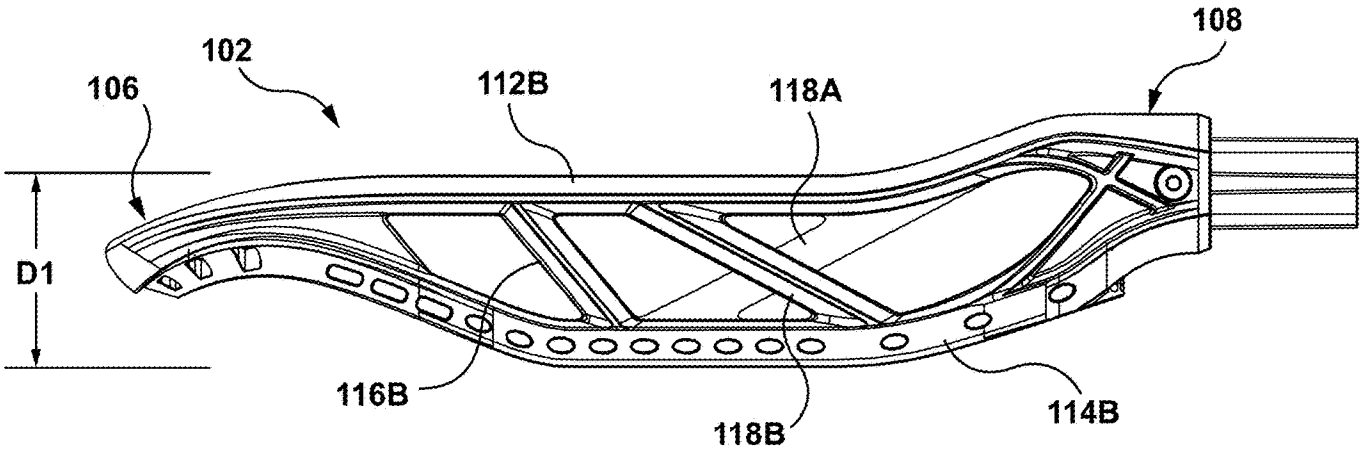
FIG. 6 is a left side view of the lacrosse head of FIG. 1.
Figure 7:
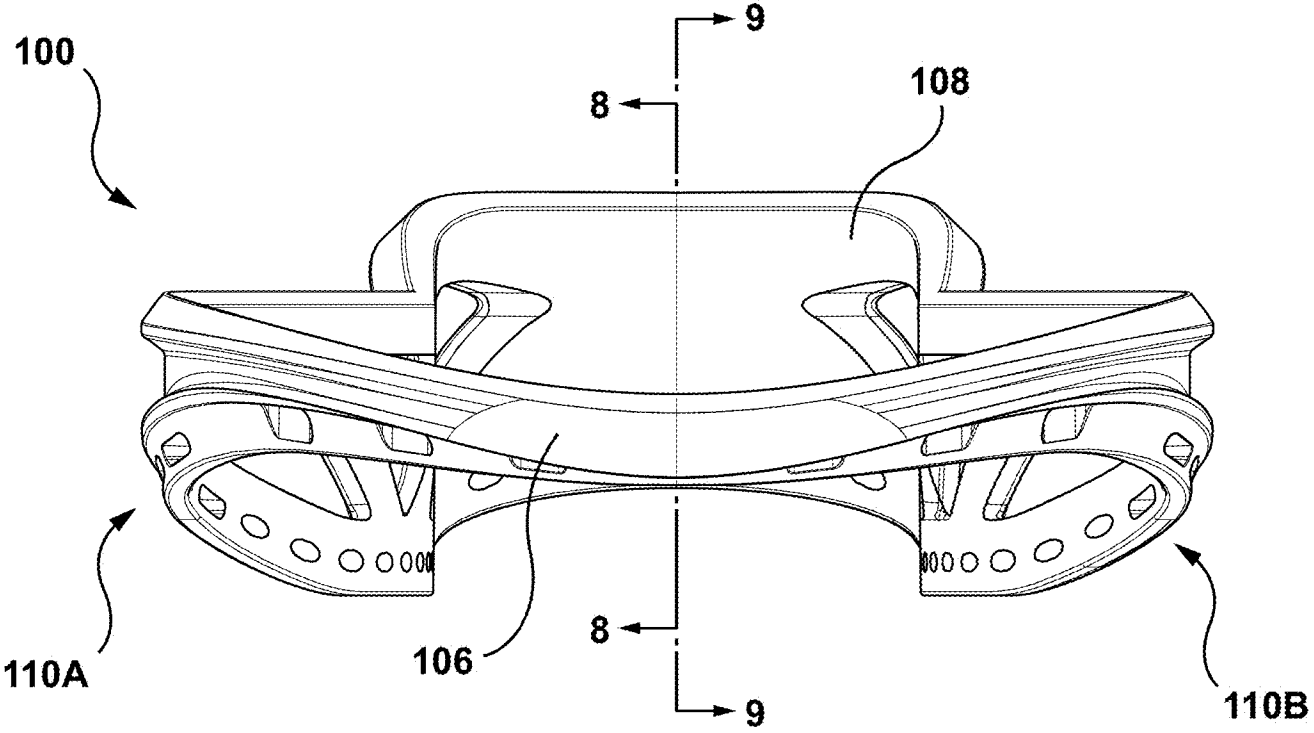
FIG. 7 is an end view of the lacrosse head of FIG. 1, the end view being taken from an end having a scoop of the frame of the lacrosse head.
Figure 10:
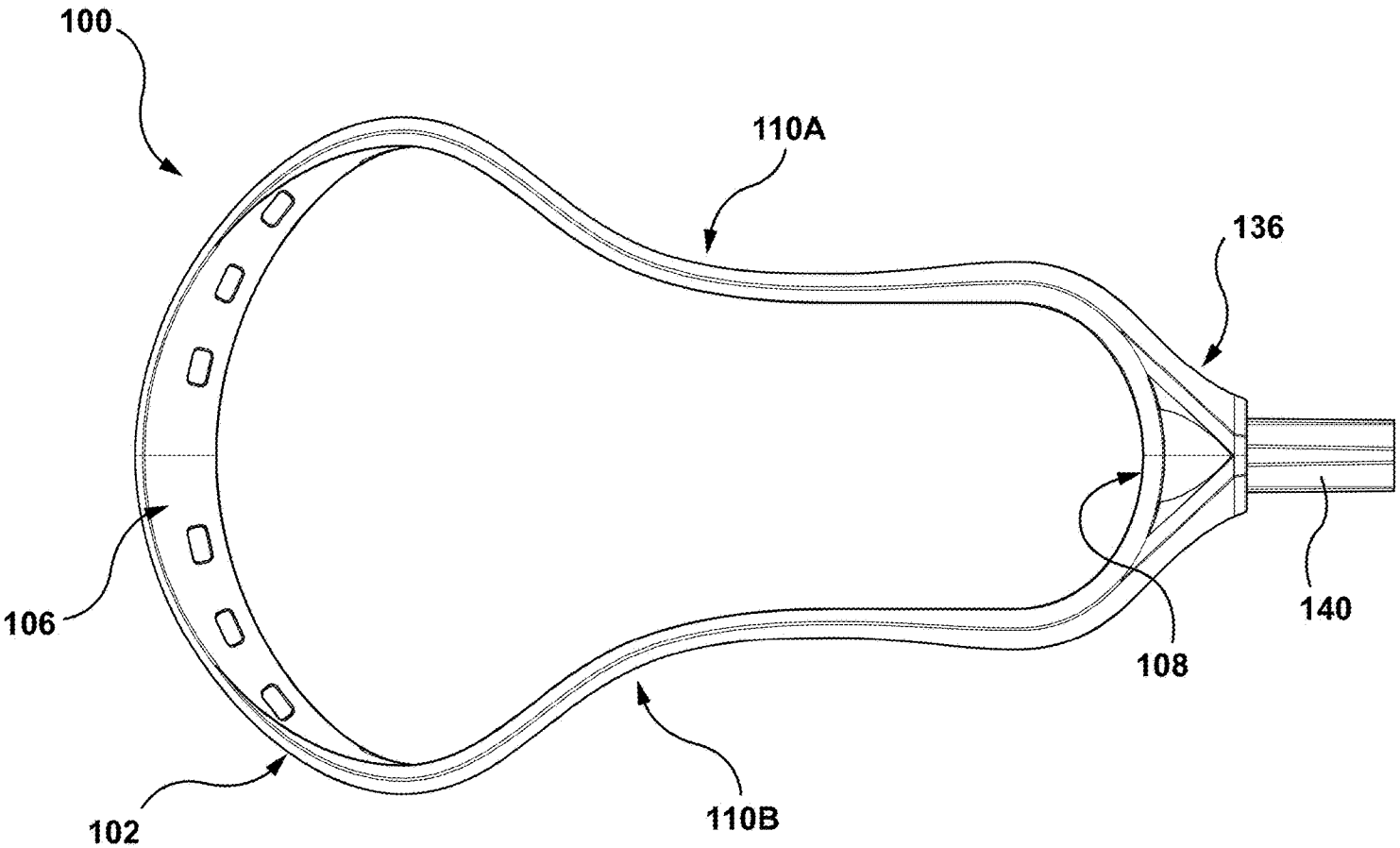
FIG. 10 is a top view of the lacrosse head of FIG. 1.

Referring to FIGS. 5 and 6, the right and left sidewalls 110A, 110B have the same maximum height. Stated another way, the top rail 112A and the bottom 114A of the right sidewall 110A are spaced apart a first maximum distance or dimension D1 and the top rail 112B and the bottom 114B of the left sidewall 110B are also spaced apart the first maximum distance or dimension D1. As such, when the frame 102 is positioned flat or along a horizontal plane, the top rails 112A, 112B of the right and left sidewalls 110A, 110B, respectively, are aligned and the bottom rails 114A, 114B of the right and left sidewalls 110A, 110B, respectively, are aligned, as shown in the side views of FIGS. 5 and 6 as well as the top view of FIG. 10. The top rail 112A and the bottom 114A of the right sidewall 110A are symmetrical with respect to the top rail 112B and the bottom 114B of the left sidewall 110B.

The first cross-struts 116A, 116B of the right and left sidewalls 110A, 110B, respectively, are the same length and extend in the same direction. As described above, each of the first cross-strut 116A and the first cross-strut 116B extends from the top rail 112A, 112B, respectively, to the bottom rail 114A, 114B, respectively, in the direction of arrow A (i.e., from the scoop 106 to the ball stop 108). Thus, as shown in each of the side views of FIGS. 5 and 6, the first cross-struts 116A, 116B of the right and left sidewalls 110A, 110B, respectively, are aligned when the frame 102 is positioned flat or along a horizontal plane. The first cross-strut 116A of the right sidewall 110A is symmetrical with respect to the first cross-strut 116B of the left sidewall 110B.

The second cross-struts 118A, 118B of the right and left sidewalls 110A, 110B, respectively, are the same length but extend in opposing directions and thereby provide the frame 102 with asymmetric sidewall patterns. As described above, the second cross-strut 118A of the right sidewall 110A extends from the bottom rail 114A to the top rail 112A in the direction of arrow A (i.e., from the scoop 106 to the ball stop 108). Conversely, the second cross-strut 118B of the left sidewall 110B extends from the top rail 112B to the bottom rail 114B in the direction of arrow A (i.e., from the scoop 106 to the ball stop 108). The second cross-struts 118A, 118B of the right and left sidewalls 110A, 110B are directly opposed to each other. Thus, as shown in each of the side views of FIGS. 5 and 6, the second cross-struts 118A, 118B of the right and left sidewalls 110A, 110B, respectively, crisscross when the frame 102 is positioned flat or along a horizontal plane. Since the second cross-struts 118A, 118B of the right and left sidewalls 110A, 110B, respectively, are spaced apart and in different planes, they do not intersect each other.

Figure 13:
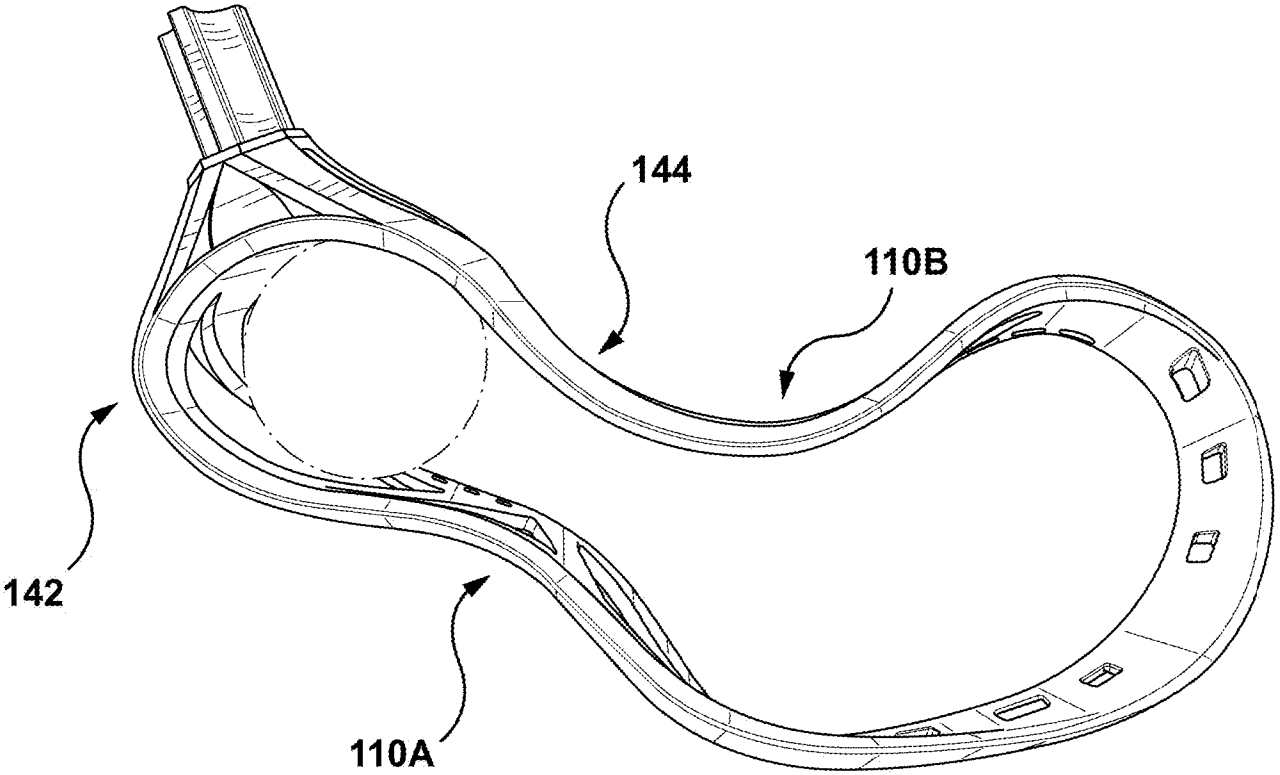
FIG. 13 is a perspective view of the lacrosse head of FIG. 1 during use in a face-off.
Figure 14:
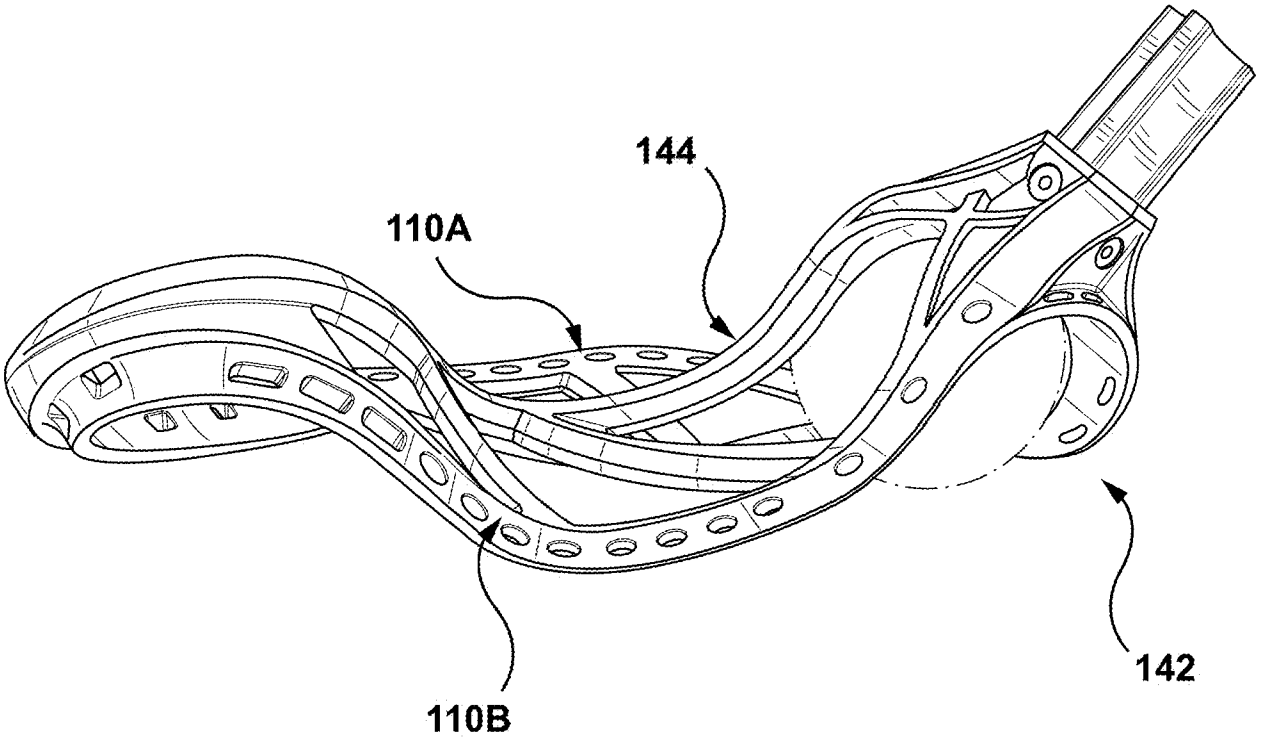
FIG. 14 is another perspective view of the lacrosse head of FIG. 1 during use in a face-off.

The length and orientation of the second cross-struts 118A, 118B of the right and left sidewalls 110A, 110B, respectively, configure the frame 102 to twist or flex during a face-off in order to trap or pinch a lacrosse ball within the right and left sidewalls 110A, 110B of the frame 102 and to push the lacrosse ball towards the ball stop 108 as will be described in more detail herein with reference to FIGS. 13 and 14. When the lacrosse head 100 is used during a face-off, the right sidewall 110A is positioned adjacent or in close proximity to the ground while the left sidewall 110B is positioned vertically in the air relative to the right sidewall 110A. With speed being an important factor during a face-off, it is advantageous for the right sidewall 110A of the lacrosse head 100 to remain adjacent or in close proximity to the ground when the lacrosse head 100 is rotated or pivoted such that the lacrosse head 100 can effectively clamp or trap the lacrosse ball.

When the lacrosse head 100 is rotated or pivoted during the face-off, the flex points of the right and left sidewalls 110A, 110B are oblique. More particularly, due to the asymmetrical patterns of the right and left sidewalls 110A, 110B, the right sidewall 110A flexes near the ball stop 108 of the lacrosse head 100 (depicted as a first flex point 142 in FIGS. 13 and 14) and the left sidewall 110B flexes the first third of the lacrosse head 100 (depicted as a second flex point 144 in FIGS. 13 and 14). In an embodiment, the first flex point 142 is positioned between 1-2 inches from the ball stop 108 while the second flex point 144 is positioned between 3-4 inches from the ball stop 108.

The second pattern 126B of the left sidewall 110B permits an optimal combination of sidewall flex and stiffness in multiple directions near the ball stop 108. Stiffness in the direction of rotation aids a player with a strong immovable leading edge to wedge under and push away the lacrosse head of the opponent. The stiffness of the left sidewall 110B in the direction of rotation is formed due to the shortened span where the second cross-strut 118B meets the bottom rail 114B. Forces from wedging or pushing down against the lacrosse head of the opponent are centered where the second cross-strut 118B meets the bottom rail 114B. If the players "lock up" during a face-off such that rotation of the lacrosse head 100 is stopped, the counter move is to dip the bottom rail 114B under the bottom rail or edge of the opponent's lacrosse head. This counter move requires that the bottom rail 114B can be pinched more easily than the top rail 112B. Stated another way, if the left and right bottom rails 114A, 114B are pinched towards each other, the bottom rail 114B is configured to be easier to pinch than if one were to pinch the left and right top rails 112A, 112B towards each other. The bottom rail 114B pinches and dips, which is aided by a higher stiffness of the top rail 112B as well as a stiffer throat 136.

In conjunction with having stiffness in the direction of rotation, the lacrosse head 100 is configured to rotate and wedge against the lacrosse head of the opponent and sufficiently flex to slip under the lacrosse head of the opponent and gain the ball. The second cross-strut 118B on the left sidewall 110B is located near the throat 136 as the lacrosse head 100 is not twisted at this location on the left side. The stiffer top rail 110A maintains a large opening at the ball stop 108 to allow for plenty of space to receive the ball. The angle and position of the second cross-strut 118B on the left sidewall 110B creates a check valve effect on the ball. More particularly, once the ball falls within the opening 130C of the left sidewall 110B, the ball is surrounded on three sides thereof and the second cross-strut 118B acts like a check valve allowing the ball to move toward the ball stop 108 and not toward the scoop 106. Any additional force applied by opponent further pushes the ball further into the ball stop 108 of the lacrosse head 100, increasing the security of the ball within the ball stop 108. Similarly, the opening 130B of the left sidewall 110B acts in a similar manner in that the first and second cross-struts 116B, 118B are angled to push the ball into the ball stop 108. The left sidewall 110B is the sidewall that is exposed to an opponent during the face-off, and thus the left sidewall 110B is configured to create a trap on the ball. The second cross-strut 118A on the right sidewall 110A is located such that it provides a surface to pinch the ball against once it is gained. The second cross-strut 118A on the right sidewall 110A is positioned further away from the ball stop 108 than the second cross-strut 118B of the left sidewall 110B, and further the second cross-strut 118A is angled toward the scoop 106 to create the relatively large opening 128C, which results in the right sidewall 110A having a more flexible top and bottom rail 112A, 114A than the left sidewall 110B near the ball stop 108. As such, the lacrosse head 100 can be rotated much easier and lower stresses are imparted in the throat 136 due to the increased flexibility. Lower stresses act to extend the life of the lacrosse head 100 because the material is not breaking down after each cycle, which keeps a more consistent flex over the life thereof.

The table reproduced herein demonstrates the above-described advantages of the lacrosse head 100. The lacrosse head 100 (formed out of two different materials, Material A and Material B), as well as three commercially available lacrosse heads having symmetrical sidewalls, underwent 1500 cycles of testing in which each lacrosse head was repeatedly subjected to the same forces/motions to simulate forces/motions during a face-off challenge. The below table includes measurements of the clamp force taken at prescribed points of the lacrosse heads to illustrate the changes in stiffness of the lacrosse heads after various increments of face-off cycles. The table below illustrates that the lacrosse head 100 has significantly less stiffness loss relative to the commercially available lacrosse heads having symmetrical sidewalls.

| | | Face Off Cycles | | | | | | | | Stiffness loss to |
|---|---|---|---|---|---|---|---|---|---|---|
| Heads Tested | Material | 0 | 100 | 200 | 300 | 400 | 500 | 1000 | 1500 | 500 cycles |
| | | Clamp Force (lbs) | | | | | | | | |
| Commercial Head #1 | Material A | 35 | 27 | 25 | 26 | 23 | 23 | 23 | 22 | −34.3% |
| Commercial Head #2 | N/A | 26 | 21 | 20 | 22 | 21 | 19 | 19 | 20 | −26.9% |
| Commercial Head #3 | N/A | 35 | 26 | 23 | 24 | 23 | 23 | 23 | 22 | −34.3% |
| Lacrosse Head 100 | Material A | 29 | 27 | 26 | 25 | 22 | 22 | 21 | 20 | −24.1% |
| Lacrosse Head 100 | Material B | 28 | 27 | 27 | 26 | 26 | 26 | 26 | 26 | −7.1% |

Figure 11:
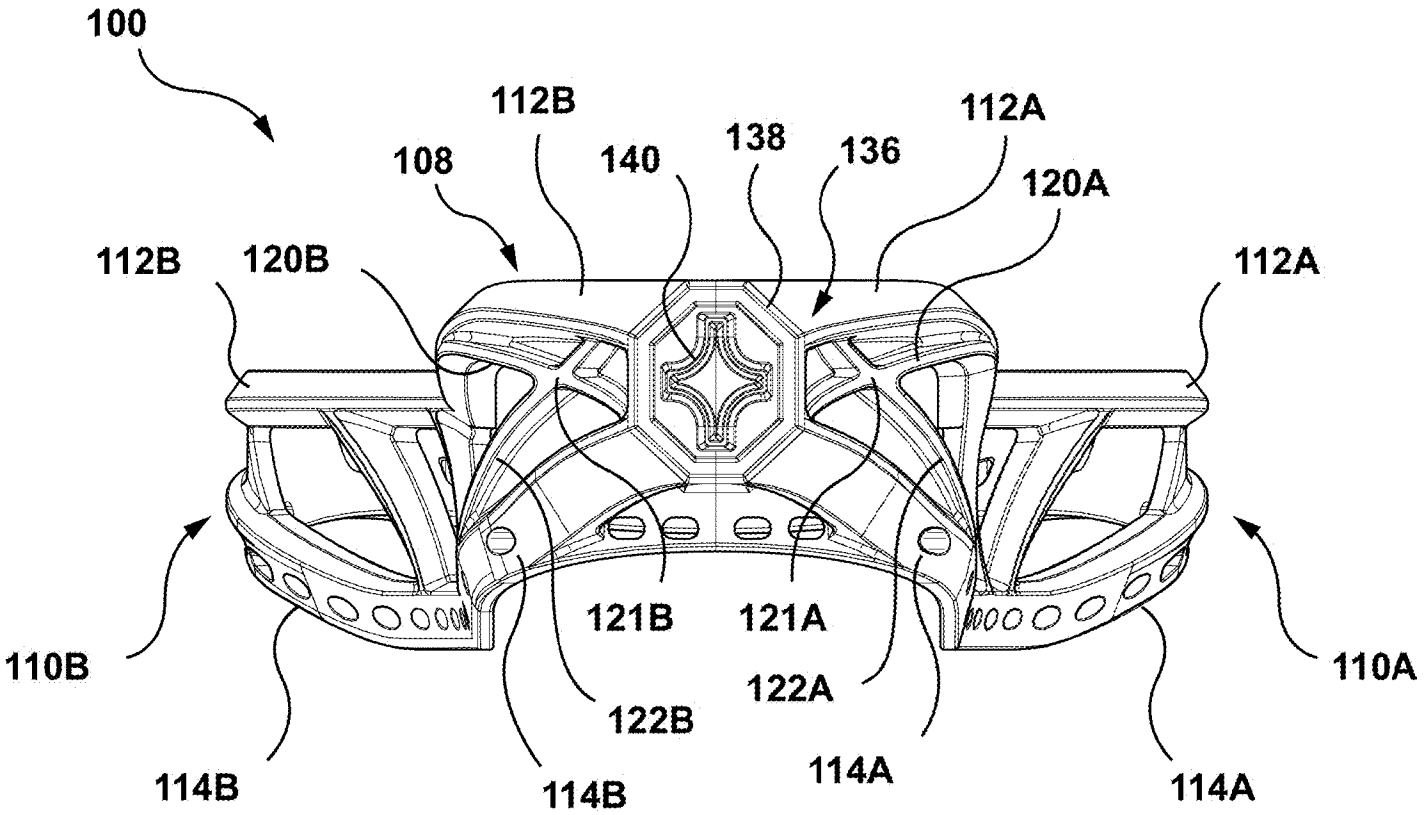
FIG. 11 is an end view of the lacrosse head of FIG. 1, the end view being taken from an end having a ball stop of the frame of the lacrosse head.

As best shown on the end view of FIG. 11, each of the right and left sidewalls 110A, 110B may further include a third cross-strut 120A, 120B, respectively, and a fourth cross-strut 122A, 122B, respectively. The third cross-struts 120A, 120B and the fourth cross-struts 122A, 122B of the right and left sidewalls 110A, 110B, respectively, are disposed closer to the ball stop 108 than the second cross-struts 118A, 118B. The third cross-struts 120A, 120B and the fourth cross-struts 122A, 122B of the right and left sidewalls 110A, 110B, respectively, function to stiffen the throat 136 of the lacrosse head 100 without adding much weight to the lacrosse head 100. The stronger or stiffer throat 136 also helps when the bottom rail 114B of the left sidewall 110B is dipped under the bottom rail or edge of the opponent's lacrosse head during a face-off. More particularly, the stronger or stiffer throat 136 helps to position this dip between 2-6 inches from the ball stop 108. Conversely, if the throat 136 is too flexible, it is more difficult to dip the bottom rail 114B of the left sidewall 110B under the bottom rail or edge of the opponent's lacrosse head during a face-off. The third cross-struts 120A, 120B of the right and left sidewalls 110A, 110B, respectively, are the same length and extend in the same direction, and the fourth cross-struts 122A, 122B of the right and left sidewalls 110A, 110B, respectively, are the same length and extend in the same direction. Stated another way, the third and fourth cross-struts 120A, 122A of the right sidewall 110A are symmetrical with respect to the third and fourth cross-struts 120B, 122B of the left sidewall 110B.

More particularly, the right sidewall 110A includes the third cross-strut 120A integrally formed with and extending between the top rail 112A and the bottom rail 114A and the fourth cross-strut 122A integrally formed with and extending between the top rail 112A and the bottom rail thereof 114A. The fourth cross-strut 122A of the right sidewall 110A is longer than the third cross-strut 120A of the right sidewall 110A. The third cross-strut 120A and the fourth cross-strut 122A of the right sidewall 110A intersect with each other at a right intersection point 121A such that they crisscross and form an "X". More particularly, the fourth cross-strut 122A extends from the bottom rail 114A to the top rail 112A in the direction of arrow A (i.e., from the scoop 106 to the ball stop 108), and conversely, the third cross-strut 120A extends from the top rail 112A to the bottom rail 114A in the direction of arrow A (i.e., from the scoop 106 to the ball stop 108).

Similarly, the left sidewall 110B includes the third cross-strut 120B integrally formed with and extending between the top rail 112B and the bottom rail 114B and the fourth cross-strut 122B integrally formed with and extending between the top rail 112B and the bottom rail thereof 114B.

The fourth cross-strut 122B of the left sidewall 110B is longer than the third cross-strut 120B of the left sidewall 110B. The third cross-strut 120B and the fourth cross-strut 122B of the right sidewall 110B intersect with each other at a left intersection point 121B such that they crisscross and form an "X". More particularly, the fourth cross-strut 122B extends from the bottom rail 114B to the top rail 112B in the direction of arrow A (i.e., from the scoop 106 to the ball stop 108), and conversely, the third cross-strut 120B extends from the top rail 112B to the bottom rail 114B in the direction of arrow A (i.e., from the scoop 106 to the ball stop 108).

Figure 12:
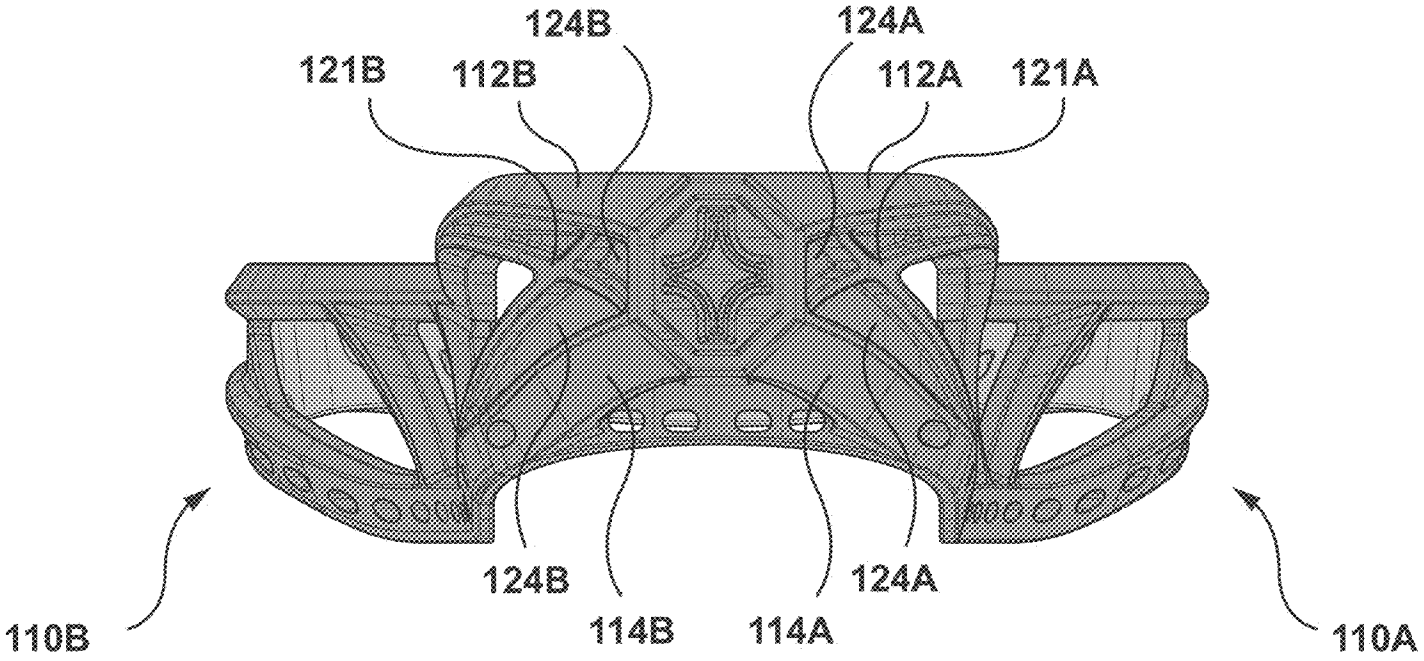
FIG. 12 is another end view of the lacrosse head of FIG. 1, the end view being taken from the end having the ball stop of the frame of the lacrosse head.

In an embodiment, as best shown in the end view of FIG. 12, a webbing or thin layer of material 124A extends within opposing openings defined by the third and fourth cross-struts 120A, 122A from the right intersection point 121A to the bottom rail 114A of the right sidewall 110A and from the right intersection point 121A to the top rail 112A of the right sidewall 110A. In addition, a webbing or thin layer of material 124A extends from the right intersection point 121A to the socket 138 defined by the throat 136 of the frame 102. Similarly, a webbing or thin layer of material 124B extends within opposing openings defined by the third and fourth cross-struts 120A, 122A from the left intersection point 121B to the bottom rail 114B of the left sidewall 110B and from the left intersection point 121B to the top rail 112B of the left sidewall 110B. In addition, a webbing or thin layer of material 124B extends from the left intersection point 121B to the socket 138 defined by the throat 136 of the frame 102. Webbings 124A, 124B further function to add strength and stiffness to the throat 136 of the frame 102. However, in another embodiment hereof, webbings 124A, 124B may be omitted.

The top edge of the ball stop 108, the top edge of the scoop 106, and the top rails 112A, 112B of the right and left sidewalls 110A, 110B, respectively, collectively define a ball receiving area of the frame 102. Further, the bottom edge of the ball stop 108, the bottom edge of the scoop 106, and the bottom rails 114A, 114B of the right and left sidewalls 110A, 110B, respectively, collectively define a ball retention area of the frame 102. In operation, the ball receiving area is where the lacrosse ball can enter or exit the lacrosse head 100 when the lacrosse ball is caught, thrown, or otherwise dislodged. In operation, the ball retention area is where the lacrosse ball is housed or retained in the lacrosse head 100, generally within the netting 104 attached to the frame 102.

While various embodiments according to the present invention have been described above, it should be understood that they have been presented by way of illustration and example only, and not limitation. It will be apparent to persons skilled in the relevant art that various changes in form and detail can be made therein without departing from the spirit and scope of the invention. For example, in an embodiment hereof, the third cross-struts 120A, 120B and the fourth cross-struts 122A, 122B of the right and left sidewalls 110A, 110B, respectively, may be omitted. In another embodiment hereof, the first cross-struts 116A, 116B of the right and left sidewalls 110A, 110B, respectively, may be omitted or modified. For example, although the first cross-struts 116A, 116B of the right and left sidewalls 110A, 110B, respectively, are described as symmetrical in the lacrosse head 100, in another embodiment hereof the first cross-struts 116A, 116B of the right and left sidewalls 110A, 110B, respectively, may extend in opposing directions relative to each other such that crisscross when the frame 102 is positioned flat or along a horizontal plane. Lastly, although the cross-struts of the frame 100 are generally shown as straight segments, the cross-struts of the frame 100 may be curved. Thus, the breadth and scope of the present invention should not be limited by any of the above-described exemplary embodiments, but should be defined only in accordance with the appended claims and their equivalents. It will also be understood that each feature of each embodiment discussed herein, and of each reference cited herein, can be used in combination with the features of any other embodiment. All patents and publications discussed herein are incorporated by reference herein in their entirety.

What is claimed is:

1. A lacrosse head comprising:

a frame including a ball stop, a scoop opposing the ball stop, a left sidewall, and a right sidewall opposing the left sidewall, the left sidewall and the right sidewall being integrally formed with and extending between the ball stop and the scoop, wherein each of the left sidewall and the right sidewall includes a top rail and a bottom rail spaced apart from the top rail, and wherein each of the left sidewall and the right sidewall includes a first cross-strut integrally formed with and extending between the top rail and the bottom rail thereof and a second cross-strut integrally formed with and extending between the top rail and the bottom rail thereof, the second cross-struts being disposed closer to the ball stop than the first cross-struts, and wherein the second cross-strut of the left sidewall is longer than the first cross-strut of the left sidewall and extends from the top rail to the bottom rail in a direction from the scoop to the ball stop, and wherein the second cross-strut of the right sidewall is longer than the first cross-strut of the right sidewall and extends from the bottom rail to the top rail in the direction from the scoop to the ball stop.

2. The lacrosse head of claim 1, wherein the first cross-strut of the left sidewall extends from the top rail to the bottom rail in the direction from the scoop to the ball stop, and wherein the first cross-strut of the right sidewall extends from the top rail to the bottom rail in the direction from the scoop to the ball stop.

3. The lacrosse head of claim 1, wherein the first cross-strut and the second cross-strut of the left sidewall do not intersect with each other.

4. The lacrosse head of claim 3, wherein the first cross-strut and the second cross-strut of the right sidewall do not intersect with each other.

5. The lacrosse head of claim 1, wherein the first cross-strut of the left sidewall and the first cross-strut of the right sidewall are the same length.

6. The lacrosse head of claim 5, wherein the second cross-strut of the left sidewall and the second cross-strut of the right sidewall are the same length.

7. The lacrosse head of claim 1, wherein each of the bottom rails of the left sidewall and the right sidewall include a plurality of holes therethrough for attaching a netting to the frame.

8. The lacrosse head of claim 7, wherein the scoop includes a plurality of holes therethrough for attaching the netting to the frame.

9. The lacrosse head of claim 1, wherein the frame further includes a throat extending from the ball stop portion in a direction away from the scoop, the throat forming a socket.

10. The lacrosse head of claim 1, wherein each of the left sidewall and the right sidewall includes a third cross-strut integrally formed with and extending between the top rail and the bottom rail thereof and a fourth cross-strut integrally formed with and extending between the top rail and the bottom rail thereof, the third and fourth cross-struts being disposed closer to the ball stop than the second cross-struts.

11. The lacrosse head of claim 10, wherein the third cross-strut and the fourth cross-strut of the left side wall intersect with each other at a left intersection point and the third cross-strut and the fourth cross-strut of the right side wall intersect with each other at a right intersection point.

12. The lacrosse head of claim 11, wherein a webbing extends from the left intersection point to the bottom rail of the left sidewall and from the left intersection point to the top rail of the left sidewall, and a webbing extends from the right intersection point to the bottom rail of the right sidewall and from the right intersection point to the top rail of the right sidewall.

13. A lacrosse head comprising:

a frame including a ball stop, a scoop opposing the ball stop, a left sidewall, and a right sidewall opposing the left sidewall, the left sidewall and the right sidewall being integrally formed with and extending between the ball stop and the scoop, wherein each of the left sidewall and the right sidewall includes a top rail and a bottom rail spaced apart from the top rail, and wherein each of the left sidewall and the right sidewall includes a first cross-strut integrally formed with and extending between the top rail and the bottom rail thereof and a second cross-strut integrally formed with and extending between the top rail and the bottom rail thereof, the second cross-struts being disposed closer to the ball stop than the first cross-struts, and wherein a first pattern of the first cross-strut and the second cross-strut of the left sidewall is asymmetric relative to a second pattern of the first cross-strut and the second cross-strut of the right sidewall with the right sidewall having a first flex point and the left sidewall having a second flex point, the first flex point being disposed closer to the ball stop than the second flex point, such that the frame is configured to twist during a face-off in order to trap a lacrosse ball between the left sidewall and the right sidewall and push the lacrosse ball towards the ball stop of the frame, and wherein the first cross-strut of the left sidewall and the first cross-strut of the right sidewall are the same length and the second cross-strut of the left sidewall and the second cross-strut of the right sidewall are the same length.

14. The lacrosse head of claim 13, wherein the second cross-strut of the left sidewall is longer than the first cross-strut of the left sidewall and extends from the top rail to the bottom rail in a direction from the scoop to the ball stop, and the second cross-strut of the right sidewall is longer than the first cross-strut of the right sidewall and extends from the bottom rail to the top rail in the direction from the scoop to the ball stop.

15. The lacrosse head of claim 13, wherein the first cross-strut of the left sidewall extends from the top rail to the bottom rail in a direction from the scoop to the ball stop, and wherein the first cross-strut of the right sidewall extends from the top rail to the bottom rail in the direction from the scoop to the ball stop.

16. The lacrosse head of claim 13, wherein the first cross-strut and the second cross-strut of the left sidewall do not intersect with each other and the first cross-strut and the second cross-strut of the right sidewall do not intersect with each other.

17. The lacrosse head of claim 13, wherein the scoop and each of the bottom rails of the left sidewall and the right sidewall include a plurality of holes therethrough for attaching a netting to the frame.

18. A lacrosse head comprising:

a frame including a ball stop, a scoop opposing the ball stop, a left sidewall, and a right sidewall opposing the left sidewall, the left sidewall and the right sidewall being integrally formed with and extending between the ball stop and the scoop, wherein each of the left sidewall and the right sidewall includes a top rail and a bottom rail spaced apart from the top rail, and wherein each of the left sidewall and the right sidewall includes a cross-strut integrally formed with and extending between the top rail and the bottom rail thereof, the cross-strut of the left sidewall extending from the top rail to the bottom rail in a direction from the scoop to the ball stop and the cross-strut of the right sidewall extending from the bottom rail to the top rail in the direction from the scoop to the ball stop, and wherein the cross-strut of the left sidewall is directly opposed to the cross-strut of the right sidewall, and no other cross-struts cross over each of the cross-struts of the left sidewall and the right sidewall.

19. The lacrosse head of claim 18, wherein the cross-struts of the right and left sidewalls are first cross-struts and wherein each of the left sidewall and the right sidewall further includes a second cross-strut integrally formed with and extending between the top rail and the bottom rail thereof, the first cross-struts being disposed closer to the ball stop than the second cross-struts.

20. The lacrosse head of claim 18, wherein the cross-strut of the left sidewall is a first cross-strut and wherein the left sidewall further includes a second cross-strut integrally formed with and extending between the top rail and the bottom rail thereof.

21. The lacrosse head of claim 20, wherein the first cross-strut of the left sidewall is longer than the second cross-strut of the left sidewall.

22. The lacrosse head of claim 18, wherein the cross-strut of the left sidewall and the cross-strut of the right sidewall are the same length.

23. The lacrosse head of claim 18, wherein the scoop and each of the bottom rails of the left sidewall and the right sidewall include a plurality of holes therethrough for attaching a netting to the frame.

24. The lacrosse head of claim 18, wherein the frame further includes a throat extending from the ball stop portion in a direction away from the scoop, the throat forming a socket.

25. The lacrosse head of claim 18, wherein a first pattern of the left sidewall is asymmetric relative to a second pattern of the right sidewall with the right sidewall having a first flex point and the left sidewall having a second flex point, the first flex point being disposed closer to the ball stop than the second flex point, such that the frame is configured to twist during a face-off in order to trap a lacrosse ball between the left sidewall and the right sidewall and push the lacrosse ball towards the ball stop of the frame.

* * * * *